US005555629A

United States Patent [19]

Leighton

[11] Patent Number: 5,555,629

[45] Date of Patent: Sep. 17, 1996

[54] GARMENT PATTERN MAKING

[75] Inventor: Douglas C. Leighton, Leeds, United Kingdom

[73] Assignee: Bracken Enterprises Limited, Leeds, United Kingdom

[21] Appl. No.: 170,362

[22] PCT Filed: Jul. 6, 1992

[86] PCT No.: PCT/GB92/01221

§ 371 Date: Jul. 8, 1994

§ 102(e) Date: Jul. 8, 1994

[87] PCT Pub. No.: WO93/00836

PCT Pub. Date: Jan. 21, 1993

[30] Foreign Application Priority Data

Jul. 4, 1991 [GB] United Kingdom ..... 9114458

[51] Int. Cl.[6] ..... A41H 3/00

[52] U.S. Cl. ..... 33/17 R; 33/12

[58] Field of Search ..... 33/11, 12, 14, 33/15, 16, 17 R

[56] References Cited

U.S. PATENT DOCUMENTS

| | | | |
|---|---|---|---|
| 327,961 | 10/1885 | Moschcowitz | 33/12 |
| 1,419,634 | 6/1922 | Koewing | 33/12 |
| 1,529,411 | 3/1925 | Koewing | 33/17 R |
| 2,892,196 | 6/1959 | Pundyk et al. | 33/12 |
| 3,523,304 | 8/1970 | Nobles | 33/12 |
| 3,883,955 | 5/1975 | Bush | 33/12 |
| 3,979,831 | 9/1976 | Lutz | 33/11 |
| 4,224,740 | 9/1980 | Gibson | 33/17 A |
| 4,428,056 | 1/1984 | Schroeder et al. | 33/11 |
| 4,542,586 | 9/1985 | Hori | 33/12 |
| 4,894,919 | 1/1990 | Ziegert | 33/17 R |

FOREIGN PATENT DOCUMENTS

| | | | |
|---|---|---|---|
| 0342534A2 | 11/1989 | European Pat. Off. . | |
| 4301698 | 7/1993 | Germany | 33/11 |
| 79/00568 | 8/1979 | WIPO | 33/12 |
| WO89/08409 | 9/1989 | WIPO . | |

*Primary Examiner*—Thomas B. Will
*Attorney, Agent, or Firm*—Rohm & Monsanto

[57] ABSTRACT

The invention relates to a system and method for the preparation of sets of patterns from which material is cut and garments produced from the cut material. Each of the patterns has formed thereon stitchlines and a number of the stitchlines are to be joined together to form a seam. The invention lies in the provision of an ease factor in the stitchlines to allow for stretch and irregularity in the material, wherein the ease factor is calculated as a percentage of a designated dominant stitchline and included in the lengths of the subservient stitchlines which are to be joined to the dominant stitchline to form the seam. The sets of patterns can be input to a computer, graded for different size of garments and the ease factors checked by computer.

12 Claims, 3 Drawing Sheets

GARMENT PATTERN MAKING

The invention relates to the preparation of patterns, and particularly those patterns to be used in the manufacture of garments. Such garments may be in the form of, for example, coats, trousers and dresses. The patterns which are the subject of the invention act as a template for the cutting of cloth to the said dimensions indicated by the pattern. The subsequent pieces of material are thus joined together to form a garment. The pattern is in effect the template from which all subsequent measurements are derived. The invention relates to the preparation of such patterns and improvements in the accuracy thereof.

At present the preparation of such patterns and the use of same to produce garments, is performed manually and with a surprisingly low degree of accuracy. The preparation and drawing up of such patterns is required to take into account the use of a factor which is commonly known as ease. The ease factor is a description of that amount of material which is allowed in addition to the required length of a seam to allow for the correct matching of two seams such that the pieces, when sewn, produce the required effect on the garment. The ease factor shall be similar for each part of a seam but may differ over the garment as a whole. In the preparation of patterns the ease factor must be taken into account such that the pattern outline to which the cloth is cut is not identical to the actual visible shape of cloth once seam as part of a garment but instead relates to the shape of material required incorporating the ease factor which ensures that the stitchlines formed therein can be sewn together to form the garment seems plus the factor allowed around the edge for ease.

At present the amount of material allocated for ease on any size of garment is largely dependant on the amount which is adjudged to be required for an "average" size garment. Furthermore the amount of ease allowed is referred to one seam only and this length of ease is then added to every other similar seam regardless and, although there are different requirements for each seam, no account is made of this. The differing requirements referred to may relate to the amount of ease required for differing lengths of seam which can alter the amount of ease required. In addition account should be taken of the variation in sizes of garments to be produced and also of the type of material from which the garment is to be produced.

A significant problem is currently encountered in that due to the relatively random nature of designating the ease factor there is no accurate process available of checking the ease factor given to ensure that the optimum factors have been allocated.

The fact that at present there is no allowance made for alteration in the amount of ease allowed either with regard to the size of garment to be produced nor to the size of seam in question leads to the production of poor quality garments in that the seams to be joined are frequently of differing lengths due to insufficient ease allowance. This has an adverse effect on the appearance and uniformity of the product. Alternatively the production of the said garments can be expensive if it is the fact that excessive ease is allowed. This leads to the percentage of cloth allowed for the requirements of ease being greater than necessary. This second problem occurs when the garment to be produced is smaller than the average size. This again produces a garment which is poorly finished and ill fitting.

Additional problems are encountered in the preparation of such patterns and specifically in the checking of the accuracy of the cut of the cloth in relation to the original pattern. This inaccuracy in cut can easily occur in preparation as any checking which is presently performed is of a visual, comparative nature. If the pattern is found to be wrong at a later date then the overall garment may be ruined and a substantial amount of downtime incurred, in correcting the faults.

The disadvantages of the current preparation methods as indicated above assume even greater significance when one considers that it is of common occurence that one undetected error in the pattern or the use of excessive material for ease can be multiplied by each of the thousands of garments produced to that pattern. This multiplication factor occurs due to the fact that garments are produced at a relatively fast rate of production such that, by the time an error is discovered several hundred or thousand garments can have been produced.

In addition problems are encountered in the subsequent joining together of various pieces of cloth if the ease factors incorporated into the seams are in error. This can lead to an uneven and weak seam being formed if for example the ease factor in one piece is larger than in the other.

A further disadvantage of the current preparation of patterns and manufacture of garments therefrom is the time which is required to produce such garments. The time incurred is increased by the errors and wastage produced by the use of poorly prepared patterns. When one considers that there are several possible sizes of garment, each of which requires alteration to the patterns, the chances of error and subsequent wastage produced is considerable.

The present invention aims to overcome the stated disadvantages in that there is provided means by which a set of patterns is provided and in each pattern ease factors are provided for each seam such that there is an optimum amount of ease provided in the pattern for each seam, each pattern being part of a set of patterns for the production of a garment of one particular size. Importantly there is also provided a means by which the checking of the accuracy of the ease factor of the master set of patterns can be done such that graded patterns can be reproduced that include comparatively graded ease factors so that garments can be manufactured therefrom in the assurance that at all sizes of garment the patterns will sew together in the same relationship as the master sample and will include optimum ease factors. Finally the manufacture of garments to a set of the patterns so prepared by the present invention is considerably faster than the preparation of the pattern using existing methods.

The present invention provides for the preparation of a master set of patterns for the cutting of material thereto such that each of the patterns of the set is prepared in relation to the specific size of garment to be produced from said pattern set, said sets of patterns incorporating an allowance in length of edges and stitchlines thereof for an ease factor, wherein the ease factor is directly related to the dimensions of a series stitchlines of the patterns in a set which are to be joined to form a seam of the garment.

A first pattern forming one of a set of patterns as described wherein in at least one of the edges formed is to be attached along a stitchline formed adjacent thereto to a stitchline of a second pattern of the set, allowance is made for the ease factor, wherein the stitchline of the second pattern is provided with an ease factor and that ease factor is related to the length of the stitchline of the first pattern.

Preferably the stitchline of the first pattern will be designated the dominant stitchline and further stitchlines of patterns to be joined thereto will have included therein ease factors which will be a percentage of the length of the dominant stitchline.

Typically an ease factor allowance for a complete stitchline will be subdivided into varying factors for each of the designated subdivisions such that the ease factor required for the overall stitchline will be met but will be distributed according to the shape of the stitchline.

Typically the length of a subservient stitchline will be the length of the dominant stitchline plus the ease factor given as a percentage of the length of the dominant stitchline.

In one embodiment the dominant stitchline for one seam in that length will include an ease factor which is required for the joining of the stitchline to another seam.

The edges of the patterns shall be preferably those which are to be joined to other pieces of material such that a seam is formed between the edges.

The ease factor to be added shall be altered to take account of differing forms of material and fabric that are to be cut from the said patterns. Furthermore the ease factor allowed shall be dependant upon the style of cut of the garment to be produced.

Each set of patterns shall be prepared specifically for one size of garments and the ease factors incorporated therein shall be directly related to each pattern set.

The preparation of the said ease factor on a pattern shall include the checking of stitchlines of differing patterns within said set which are to be joined together to ensure that the edges when so joined together shall matchingly engage.

The said preparation of pattern stitchlines shall involve the incorporation of notches into the pattern to subdivide said stitchlines to facilitate the checking of the ease factor allowed between corresponding lengths between said notches such that the edge lengths when combined will match.

There shall be provided as part of the present invention the facility of a computer into which a set of patterns may be input in graphical form to form a master set of patterns for a particular size of garment, wherein there is provision for the ease factor to be incorporated therein.

Preferably there shall be provided means by which any variation in edge lengths can be corrected using the computer prior to plotting of said set of pattern.

Preferably it shall be possible to indicate the accuracy of each stitchline or edge in respect to the designated ease allowance and to compare this variation to a designated tolerance level.

Preferably a facility shall be provided to allow the alteration of said ease factor and overall length of a section to bring this within the designated tolerance limit, prior to the pattern being produced.

In one embodiment the system allows the ease factor allowed on the stitchlines which form seams in the master set of patterns to be maintained comparatively as the dimension of the master set of patterns is varied to manufacture therefrom garments of different size. The master set and said patterns are thus graded wherein the ease factor allowed varies proportionately as the size of the patterns vary.

The present invention shall provide for the plotting of said set of patterns once input to the computer from the computer onto a suitable surface from which a garment can be produced.

It shall preferably be possible to print sets of patterns of differing sizes from the computer by the input into the computer of the size of garment required, wherein the computer shall refer to a master set of patterns for that garment and alter dimensions thereof to suit the size of garment required.

Preferably a minimum of information shall be required to be input to the computer to produce a print of a set of patterns for one size of garment.

Preferably the information to be input shall allow variation in the type of material to be used to be taken into account in the ease factor allowed in the pattern set produced, and the patterns altered accordingly prior to the plotting of the patterns set.

In a further aspect of the invention there will be provided a capability in the computer facility wherein the sets of patterns held on memory will be altered to take into account individual measurements and provide patterns to suit particular shapes, in a made to measure capacity.

Furthermore, there may be provided in association with the preparation of at least one pattern of a set of patterns for the inclusion of a guideline therein such that the accuracy of cut of the material can be easily and quickly checked in comparison to the guideline wherein the guideline is offset from the perimeter of the pattern.

Typically the pattern offset guideline will have a constant offset along the perimeter of the pattern.

In one embodiment the pattern is used to allow the material to be cut to the dimension of the pattern, said pattern is then cut along the offset guideline and placed on top of cut material to allow a check that said material offset is constant in relation to the perimeter of the pattern.

Preferably it shall be possible to plot at the same time as a pattern an offset guideline on the pattern, said guideline having been preset in relation to the amended pattern.

A specific embodiment of the invention shall now be described with reference to the accompanying drawings wherein.

Figure 1:
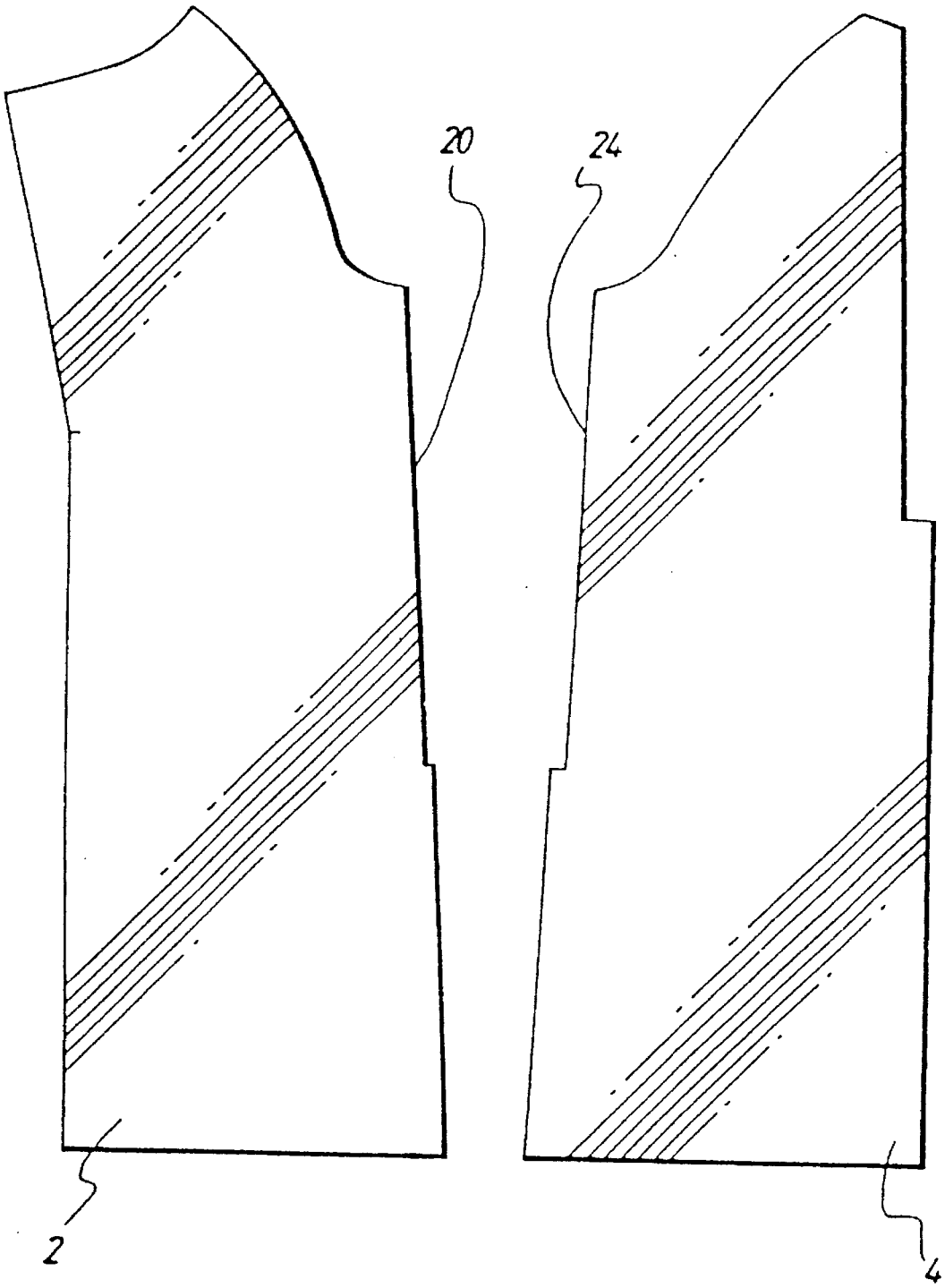
FIG. 1 illustrates two patterns of a pattern set for a garment.
Figure 2:
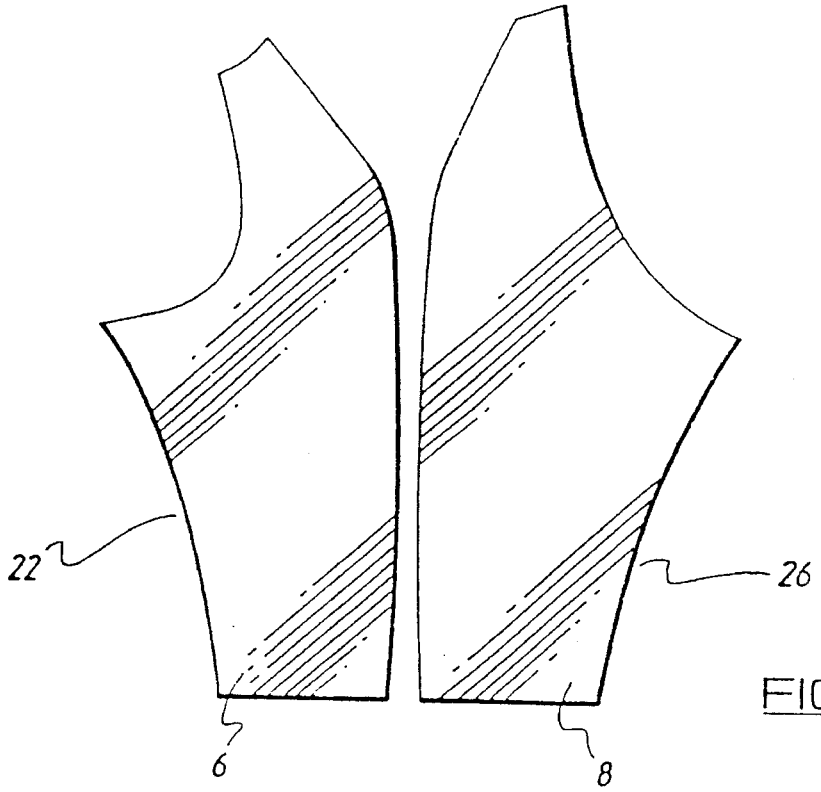
FIG. 2 illustrates two further patterns to interfit with those patterns of FIG. 1.

Referring to the drawings and firstly to FIGS. 1 and 2 showing several patterns wherein there is a back pattern 2, a front pattern 4, a front sleeve pattern 6, and a back sleeve pattern 8. The said patterns being integral parts for the production of a garment. With reference to the forming of one particular Join of the garment, pattern 4 is provided with a stitchline 20 which combines with a stitchline 22 of pattern 6 to join with stitchline 24 of pattern 2 combined with seam 26 of pattern 8.

Figure 3:
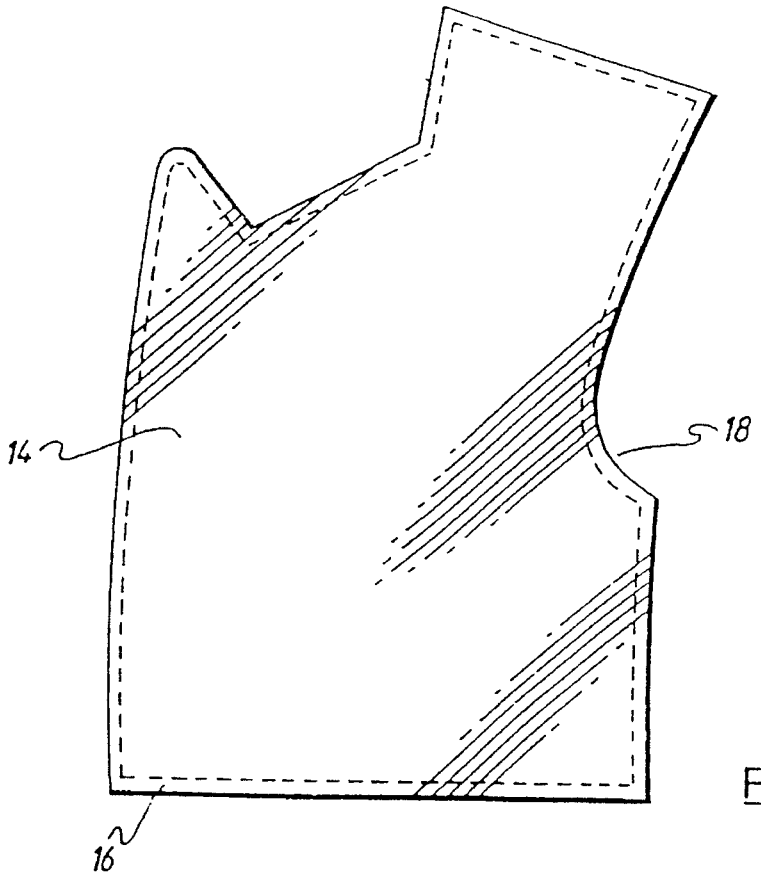
FIG. 3 shows a pattern with an offset guideline marked thereon.

FIG. 3 of the drawings illustrates a further pattern 14 wherein there is marked an offset guideline 16 which is offset from the perimeter 18 of the pattern.

To illustrate the preparation of such a pattern and with reference to FIGS. 1 and 2 and specifically to patterns 2, 4, 6 and 8. In the preparation of the patterns and in particular the provision of the ease factor, stitchline length 20 of pattern 4 is calculated, with the ease factor taken into account as a percentage of the overall length of the said stitchline 20. The ease factor is therefore dependant on both the particular size of the garment to which the pattern 4 relates and account is also incorporated into the ease factor of the type of fabric to be used in the manufacture of the garment. The ease factor is therefore incorporated into the sizing of this stitchline 20.

The ease factor incorporated into the stitchline 20 can therefore now be incorporated if required into the stitchlines 22, 24 and 26, wherein the ease factor is given as a percentage value and the length of each stitchline is thus the required stitchline length plus the percentage of that stitchline length required for the ease factor.

This therefore ensures that by the accurate preparation of the subsequent stichline 22, 24 and 26, incorporating values for the ease factors, that when the said stitchline are so joined together, the seam produced is both accurate and strong such that there is no mismatching of sizes between the various stitchline and that there is sufficient material available to produce the said strong join. This preparation of the stitchline incorporating the ease factor can be undertaken for all seams between patterns such that those stitchlines which are required to be joined together can be dimensioned with a similar ease factor percentage as those stitchlines to which they are to be joined.

In the preparation of the pattern 14 shown in FIG. 3 the preparation stage so described above has been performed and the pattern dimensioned to suit. The offset guideline 16 is now applied to the pattern 14 such that the guideline 16 is offset from the perimeter 18 of the pattern.

With the offset in place the pattern 14 is placed over the material to be used and the material cut to match the pattern. As this is a repetitive task it has been found that errors occur and that checking of the cut is required therefore the inclusion of the guideline 16 in the pattern 14 enables the cut material Outline to be checked against the offset line 16 to ensure that the offset is constant along the perimeter of the material when cut.

In a further embodiment the preparation of the patterns may be performed with the aid of computer technology but still using the preparation described above wherein the lengths of stitchlines to be joined together are checked for comparable lengths incorporating the ease factor upon the inputting of said pattern sets into the computer. In this case indication is given as to any differences in length between each of the stitchlines, which are to be combined to form a particular seam such that the preparer can decide whether the differences are within allowable tolerance limits. Alterations can therefore be undertaken on the computer itself.

There shall be provided a plotter means for the plotting of said sets of patterns from the computer. In addition it is envisaged that it shall be possible to produce plottings of further sets of patterns for garments of similar design but of different sizes. It shall be possible to produce said plottings of pattern sets by inputting a minimum of information in the form of the size of garment to be made and or the material type. The computer shall have the capacity to alter the master pattern set dimensions as required.

Figure 4:
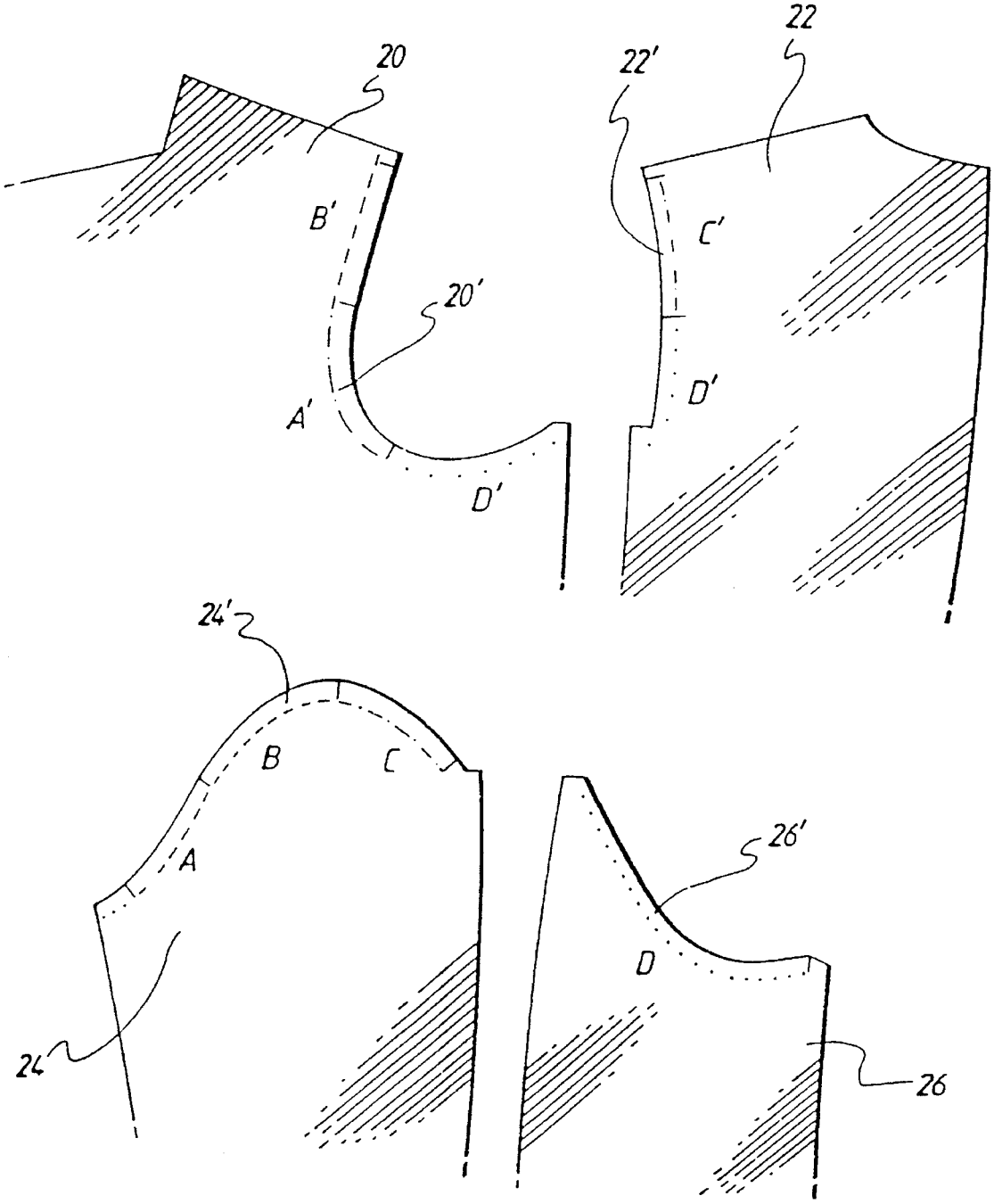
FIG. 4 illustrates the method by which said patterns can be checked and subsequently joined.

Referring now to FIG. 4 there is shown a further embodiment of producing a master set Of patterns 20, 22, 24, 26 each of which have a stitchline 20', 22', 24', 26' which when joined together form the seam between the shoulder and top of a sleeve in a jacket.

In this case a dominant stitchline is designated as 24' to which the other stitchlines are to be Joined and notches define lengths A, B, C, on pattern 24 and also a forth length D on 26. Similarly lengths A', B', C', D' are defined in stitchlines 20' and 22'.

The fabric of the garment is then analysed and the style of cut considered. From this analysis an ease factor to be incorporated into subservient stitchlines is decided upon such that when joined to the dominant stitchline the length of the subservient stitchline plus the ease factor allowance value e.g. 8% of the length of the dominant stitchline. The ease factor is provided in this embodiment in each of the subservient stitchlines 20', 22' which is split into A', B', and C' and such that the ease factor provided allows the stitchlines to be joined to the dominant stichline 24' split into A, B, and C effectively and efficiently together. Furthermore although the overall ease factor is a set percentage in this case the percentage value allowed in each of the lengths A', B', and C', can vary as long as the overall ease factor of the stichlines 20', 22' is that which is allocated.

Given that each seam is measured in this manner this set of patterns is now input into the computer and held therein.

For each graded set of patterns provided by manual or computer calculation i.e. for different sizes of garments, the ease factor allowances which have been provided are checked. The check can be made using the following formula wherein;

with reference to FIG. 4; with stitchline 24', piece 24, has in this instance, for purposes of example, been designated the dominant stitchline, and stitchlines 20' (A', B') piece 20 and 22' piece 22 (C') are designated the subservient stitchlines in which an ease factor allowance is included in the length thereof, and to check the ease factor allowance, the lengths of these stitchlines are calculated as follows:

$$\frac{(\text{Stitchline } 20'(A'B') + \text{Stitchline } 22'(C')) - \text{Stitchline } 24'(A,B,C)}{\text{Stitchline } 24'(A,B,C)} \times 100$$

wherein the ease factor allowance is expressed as a percentage of the length of the dominant stitchline and wherein values for every stitchline are obtained and then input to the computer which will ensure that the sizes have been altered in such a way that the ease factor as a percentage value remains constant for each set of patterns produced for each size of garment, although the actual length of the stitchline will have altered due to the down or upgrading of the set of patterns.

If there are irregularities then alterations will be required to the patterns to ensure that the ease factor is brought within acceptable limits.

The system also provides a second stage wherein the differing measurements obtained for each of the stitchline lengths for each of the pattern sets for each size of garment to meet the required ease factor are used to alter the corresponding seam lengths.

This is done to ensure that the seam to be formed by the new stitch line lengths remains in the same shape as the master garment. This therefore requires not only the seam length to be altered but also for the alteration to be of a shape which is proportionately linked with the stitchline shape.

The process is done by first ensuring that the seam lengths are as required and then ensuring that the notches defining lengths A, B, C, D will match with notches defining lengths A', B', C', D' on the new size patterns. With straight line seams this is of no great problem however curved seams do cause problems. The computer allows the user to first define the position of the notches on the dominant edge and subsequently the notches on the other subservient edges will then be defined relative to the dominent notches. This is done by computer using a first seam which has the correct altered size.

The advantages produced by the preparation of the pattern sets in the manner so described above are that the patterns are far more accurate than those patterns produced by conventional preparation techniques. Furthermore the preparation of patterns by the invention described allows the pattern maker to easily and simply take into account the variance in the ease factor required for differing garment sizes and for the use of differing types of material in the production of said garments. The ease factor which is taken into account is therefore tailored to meet the requirements of each particular pattern and is not, as was previously the case, related to the "average" size garment ease requirements.

The preparation of the pattern in this manner serves to reduce the amount of material which is currently disposed of as waste due to inaccurate cutting of the material from the said pattern. The provision of the offset line on the pattern serves to provide a quick and efficient checking method whereby the examiner on the shopfloor can easily identify whether the cut material accurately mirrors the perimeter of the pattern. Thus cut material which would previously have been passed at the checking stage and not be found to be defective until further along the production line can be identified and rejected at an early stage thereby reducing both the amount of material wasted and the subsequent downtime in production is reduced.

Pattern preparation with the correct ease factor taken into account using the present invention allows the subsequent production time of the garment manufactured to the patterns to be greatly reduced. This is due to the fact that the efficient and accurate pattern preparation as described promotes an efficient and quick preparation time wherein it can be taken as a fact that those seams which are required to be fitted together will do so as the ease factor in each seam is of a similar percentage value of the required seam length.

The production of pattern sets in which the dimensions of the said patterns are directly related to that size of garment to be manufactured ensures that an optimum set of patterns is produced for each garment size.

The ability to perform this pattern preparation with the aid of computer technology, wherein the ease factor and the offset guideline can be incorporated into the pattern enables the preparation time for these patterns to be further reduced. The use of computer technology also enables the whole system of pattern preparation to be integrated with an automated garment manufacturing system wherein the required ease factor can be input for one seam and the optimum lengths for the other seams will thus be calculated while taking into account the ease factor preset. This should further reduce overall production times and also reduce, as will the manual preparation, the number of garments which are currently rejected due to poor pattern preparation.

I claim:

1. A method for preparing a set of patterns for the cutting of material thereto for forming pieces which, when joined together form a garment, each of the patterns in the set prepared in relation to a specific size of garment to be produced therefrom and the patterns are provided with stitchlines in positions along which the cut material will be sewn such that groups of the stitchlines, when joined together, form a seam of the garment, and at least one of the stitchlines in at least some of the groups is provided with an allowance in the length thereof as an ease factor and wherein the ease factor allowance, for each of the groups of stitchlines is provided and checked during the creation of the set of patterns by following the steps of:

analyzing the fabric from which the garment is to be made and the style of the garment;

allocating an ease factor value for that seam;

selecting one of the stitchlines of the seam as a dominant stitchline, the remainder as subservient stitchlines;

including the ease factor allowance in at least one of the subservient stitchlines;

comparing the total length of the subservient stitchlines, including the ease factor allowance, with the length of the dominant stitchline and checking that the difference between the lengths is equivalent to the allocated ease factor allowance; and repeating the steps for each of the groups of stitchlines for each seam in the set of patterns.

2. A method according to claim 1 wherein the first set of patterns developed is used as a master set of patterns and the measurements of the stitchlines thereof, including ease factor allowances, can be graded up and/or down when forming subsequent sets of patterns for other sizes of the garment and, for each group of stitchlines for each seam in each new set of patterns, checking the difference between the length of the subservient stitchlines and the dominant stitchline in each group to insure that the ease factor allowance is equivalent to the allocated ease factor allowance for the corresponding seam in the master set of patterns.

3. A method according to claim 1 wherein the allocated ease factor allowance is expressed as a percentage of the length of the dominant stitchline length.

4. A method according to claim 1 wherein the allocated ease factor allowance is expressed as a fixed amount to be provided in specific stitchlines in the group.

5. A method according to claim 1 wherein the allocated ease factor allowance is provided in one of the subservient stitchlines in the group.

6. A method according to claim 1 wherein the allocated ease factor is provided in a plurality of the subservient stitchlines in the group such that, in combination, the allocated ease factor allowance value is provided.

7. A method according to claim 1 wherein the ease factor allowance for each group of stitchlines for each seam in the master set is entered on a records, and when a new set of patterns is created for a new size of the garment, the ease factor allowance for each of the seams of the new set is compared to the ease factor allowance value held on a record for the comparable seem on the master set, and its equivalent, the stitchlines in that group are approved.

8. A method according to claim 1 wherein the stitchlines in said group are sub-divided and the ease factor for each subdivision is varied and the lengths of each of the subdivisions including an ease factor are combined to provide the ease factor allowance required.

9. A method according to claim 8 wherein the stitchlines included notches formed at intervals there along to subdivide the stitchlines.

10. A method according to claim 1 wherein the values for the stitchlines of the master set of patterns and the ease allowance for each seem are held on computer, and upon input of the required size of garment to be produced, a set of patterns for that size can be created incorporating stitchlines and ease factors, and during the creation of the set of patterns, the allocated ease factor allowance for each seem of the new set of patterns is checked against the corresponding allocating ease factor allowance on the master set of patterns, and if equivalent, with the stitchlines for the seam are approved.

11. A method according to claim 10 wherein each new set of patterns created is stored on the computer memory and can be recalled to print further sets of patterns for that size of garment.

12. A method according to claim 10 wherein the patterns include a guideline, offset from the pattern edge.

* * * * *